US011133617B2

(12) United States Patent
Herrmann et al.

(10) Patent No.: US 11,133,617 B2
(45) Date of Patent: Sep. 28, 2021

(54) PLUG CONNECTION HAVING AN AUXILIARY CONTACT

(71) Applicant: Weidmüller Interface GmbH & Co. KG, Detmold (DE)

(72) Inventors: Michael Herrmann, Detmold (DE); Jürgen Ziemke, Detmold (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/629,646

(22) PCT Filed: Jul. 17, 2018

(86) PCT No.: PCT/EP2018/069448
§ 371 (c)(1),
(2) Date: Jan. 9, 2020

(87) PCT Pub. No.: WO2019/016241
PCT Pub. Date: Jan. 24, 2019

(65) Prior Publication Data

US 2020/0203871 A1 Jun. 25, 2020

(30) Foreign Application Priority Data

Jul. 19, 2017 (DE) ..... 202017104284.7

(51) Int. Cl.
*H01R 13/24* (2006.01)
*H01R 13/187* (2006.01)
*H01R 13/11* (2006.01)

(52) U.S. Cl.
CPC ..... *H01R 13/187* (2013.01); *H01R 13/112* (2013.01); *H01R 13/113* (2013.01); *H01R 2201/20* (2013.01)

(58) Field of Classification Search
CPC ..... H01R 13/10; H01R 13/11; H01R 13/15; H01R 13/112; H01R 13/113; H01R 13/114; H01R 13/187; H01R 2201/20
(Continued)

(56) References Cited

U.S. PATENT DOCUMENTS 8,936,495 B2 1/2015 Hatch
9,373,908 B2 * 6/2016 Hatch ..... H01R 13/2421
(Continued)

FOREIGN PATENT DOCUMENTS

DE 10107794 A1 8/2002
DE 102006037904 A1 2/2008
(Continued)

*Primary Examiner* — Khiem M Nguyen
(74) *Attorney, Agent, or Firm* — Laubscher & Laubscher, P.C.

(57) ABSTRACT

An electrical plug connection has two main contacts—one plug-in contact and one socket contact configured to mate when the contacts are connected. In the connected state, the contacts contact each other at a main contact point. An auxiliary contact is associated with one of the two main contacts to form an assembly and plug unit. The auxiliary contact is designed as a spring contact which contacts the other main contact in the region of a second contact point. When the two plug-in contacts are disconnected, the auxiliary contact is connected in an electrically non-conductive manner to the main contact with which it is associated. In the mating or connected state where the two main contacts contact each other, the auxiliary contact contacts the other main contact with which it is not associated to form an assembly and plug unit at an auxiliary contact point for measuring the power loss across the plug connection.

16 Claims, 22 Drawing Sheets

(58) Field of Classification Search
USPC ..... 439/816, 819, 824
See application file for complete search history.

(56) References Cited

U.S. PATENT DOCUMENTS

| | | | | |
|---|---|---|---|---|
| 9,680,264 | B2 * | 6/2017 | Polinski | H01R 24/58 |
| 9,748,680 | B1 * | 8/2017 | Huang | H01R 12/714 |
| 10,514,402 | B2 * | 12/2019 | Klapper | H01R 4/34 |
| 2007/0059973 | A1 | 3/2007 | Fabian et al. | |
| 2017/0089965 | A1 | 3/2017 | Klapper | |
| 2017/0093098 | A1 | 3/2017 | Polinski | |

FOREIGN PATENT DOCUMENTS

| | | | |
|---|---|---|---|
| DE | 102011013418 | A1 | 9/2012 |
| DE | 102014006654 | A1 | 11/2015 |
| WO | 2015185456 | A1 | 12/2015 |

* cited by examiner

PLUG CONNECTION HAVING AN AUXILIARY CONTACT

This application is a § 371 National Stage Entry of International Patent Application No. PCT/EP2018/069448 filed Jul. 17, 2018. Application No. PCT/EP2018/069448 claims priority of DE 20 2017 104 284.7 filed Jul. 29, 2017. The entire content of these applications is incorporated herein by reference.

BACKGROUND OF THE INVENTION

The power loss across a plug connection can easily be detected with simple devices in plug connections of the generic type.

An electrical power interface of a vehicle, particularly a commercial vehicle or rail vehicle, is known from DE 10 2014 006 654 A1. Such a device includes a first power contact, which can be brought into contact with a second power contact for establishing an electrical power path. An auxiliary contact which is electrically insulated from the first power contact is arranged in such a manner relative to the first power contact that when the first power contact and the second power contact have been brought into contact with each other to form the electrical power path, the auxiliary contact also contacts the second power contact. The auxiliary contact is electrically connected in parallel to the first power contact via a measuring path. A measuring device for detecting the state of an electrical contact between the first power contact and the second power contact is configured such that a voltage drop at the electrical power interface and/or a variable correlating with the voltage drop is determined via the measuring path. The auxiliary contact is associated with the plug-in contact.

It is desirable to provide a plug connection that can also be used outside of power electronics and which is designed in a simple manner such that power loss across the plug connection can be easily determined using simple devices.

It is known from 10 2011 013 418 A1 to use a spring to press a socket contact with a contact force against a pin contact. Similar plug connections are also described in US 2017/0093098 A1 and US 2007/0059973 A1.

SUMMARY OF THE INVENTION

Accordingly, it is a primary object of the invention to provide an electrical plug connection having two main contacts, one plug-in contact and one socket contact, which contact each other in a mating fashion to form a main contact point. An auxiliary contact is associated with one of the two main contacts. The auxiliary contact, together with the main contact, forms an assembly and plug unit and is designed, when the main contacts are mated or connected, to contact the other main contact in the region of a second contact point. The auxiliary contact is preferably a spring contact, such that, when the two main contacts are not connected, the auxiliary contact is connected in an electrically non-conductive manner to the main contact with which it is associated. In the connected state where the two main contacts; i.e. the plug-in contact and the socket contact contact each other, the auxiliary contact contacts the other main contact with which it is not associated to form an assembly and plug unit at an auxiliary contact point K2. This is done to measure the power loss across the plug connection.

The auxiliary contact is preferably integrated in a circuit for voltage measurement. It is preferred that the auxiliary contact contacts the other main contact with which it is not associated in the manner of an assembly and plug unit with either the socket contact or the plug-in contact in the mated state of the plug connection at an auxiliary contact point as a portion of a circuit for measuring the power loss across the plug connection.

Due to its resilient design, the auxiliary contact can easily compensate any geometrical tolerances that occur at the main plug connection when plugging the socket contact and the plug-in contact together, such that a precise measurement is always possible via the auxiliary contact despite the tolerances. Such tolerance particularly occurs at plug connections not designed for power electronics which are also suitable for transmitting smaller wattages. In this respect, the plug connection is particularly suitable for this field of application and can be used in circuit board connectors and/or circuit board edge connectors or the like. The circuit board edge can include pin-like contact areas. It then forms the plug-in contact or the at least one pin contact.

A contact is designed, intended and used to form a contact point as part of an electric circuit through which a current flows or can flow.

Several of the main contacts and auxiliary contacts of the plug connections can be combined in a higher-level connector casing.

In this manner, a second contact point—that is, the contact point between the auxiliary contact and the one main contact—can be used for measuring the power loss across the plug connection since this contact point is formed in the immediate vicinity of the first contact point such that the required measurements can be performed with a high degree of precision.

It is preferred that the one main contact is designed as a pin contact and that the other main contact is designed as a socket contact with a leaf spring effect, together with the auxiliary contact forming the assembly and plug unit. An advantage is that the plug-in contact, for example a single-piece pin contact, does not require design changes. This means that standard pin contacts such as round, square, or rectangular pins, particularly solder pins, can be used as plug-in contacts. The term "pin contacts" also includes various types of blade contacts.

It is also easier from a design point of view to associate the auxiliary contact with the socket contact and not with the plug-in contact. In order to compensate for geometrical tolerances, it is preferable to design the auxiliary contact as a spring contact including one or more leaf springs. According to an alternate embodiment, the auxiliary contact can also be associated with the pin contact.

The spring force of the auxiliary contact acts on the second main contact in a different direction than the other main contact to house the auxiliary contact at the socket contact as the one main contact without impairing the function of the other main contact. According to one embodiment, it is advantageous that the spring contact acts on the pin contact perpendicular to the force direction in which the socket contact forming a main contact is acting on the pin contact.

In this manner, various compact embodiments can be implemented such as one in which the auxiliary spring contact acts laterally on the pin contact or one in which the auxiliary spring contact acts on the tip of the second main contact designed as a pin contact against the plug-in direction in which the pin contact can be inserted into the socket contact forming the main contact.

According to another embodiment, the auxiliary spring contact and the socket contact forming the one main contact are arranged and/or held at a distance from each other in an insulator. The joint assembly unit of the main contact and the auxiliary contact that can be plugged and handled is thus implemented in a simple manner.

According to a further embodiment, the auxiliary spring contact and the socket contact forming the one main contact are spaced from each other in an outer casing as the insulator. Rather than providing an insulator and an outer casing as separate components, these two functions are both implemented by the outer casing alone.

Accordingly, a plug connection is possible having two connectors, one of which includes multiple first main contacts and resilient auxiliary contacts associated with them, and the other including multiple second main contacts each in outer casings which can be plugged together.

BRIEF DESCRIPTION OF THE FIGURES

The invention is described below and with reference to the drawing, in which.

DETAILED DESCRIPTION

Figure 1A:
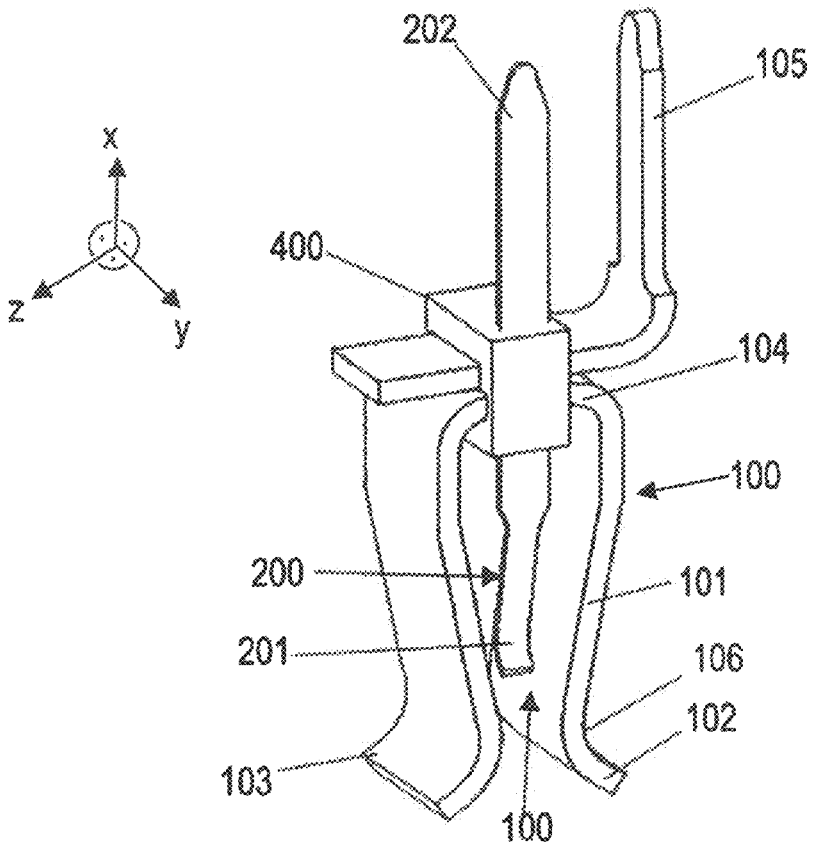
FIG. 1*a* is a perspective view of a first socket contact with an auxiliary contact.
Figure 1B:
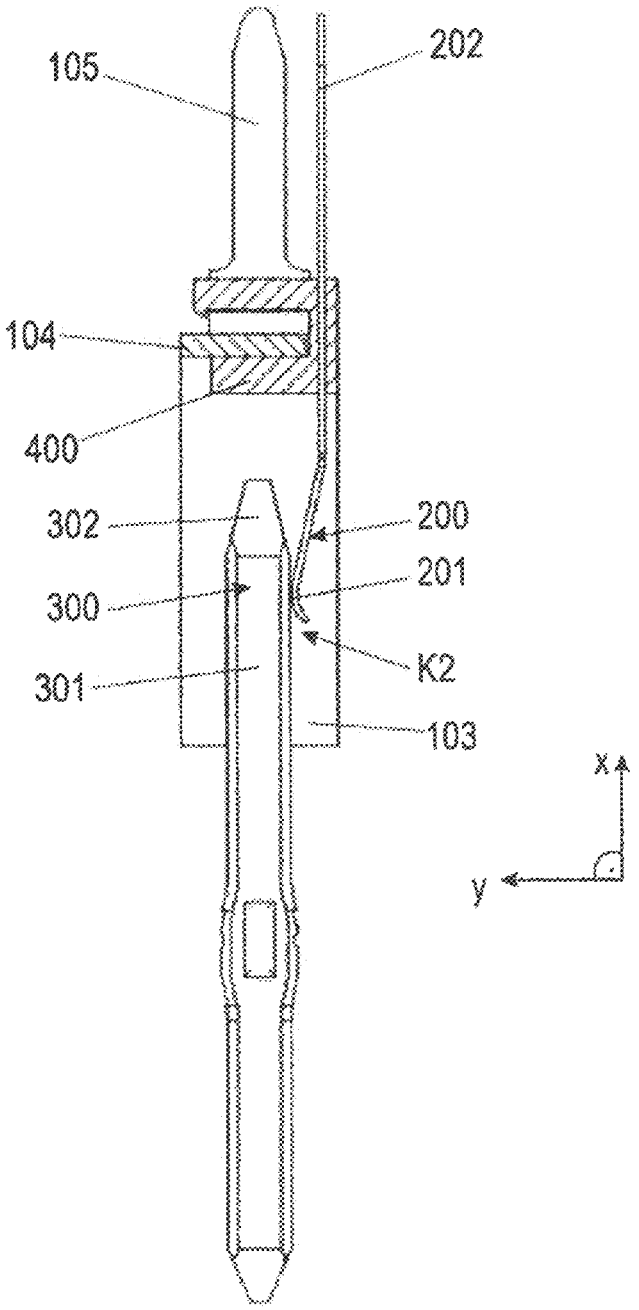
FIG. 1*b* is a partial sectional view of the socket contact of FIG. 1*a* with a pin contact to form a plug-in contact.
Figure 1C:
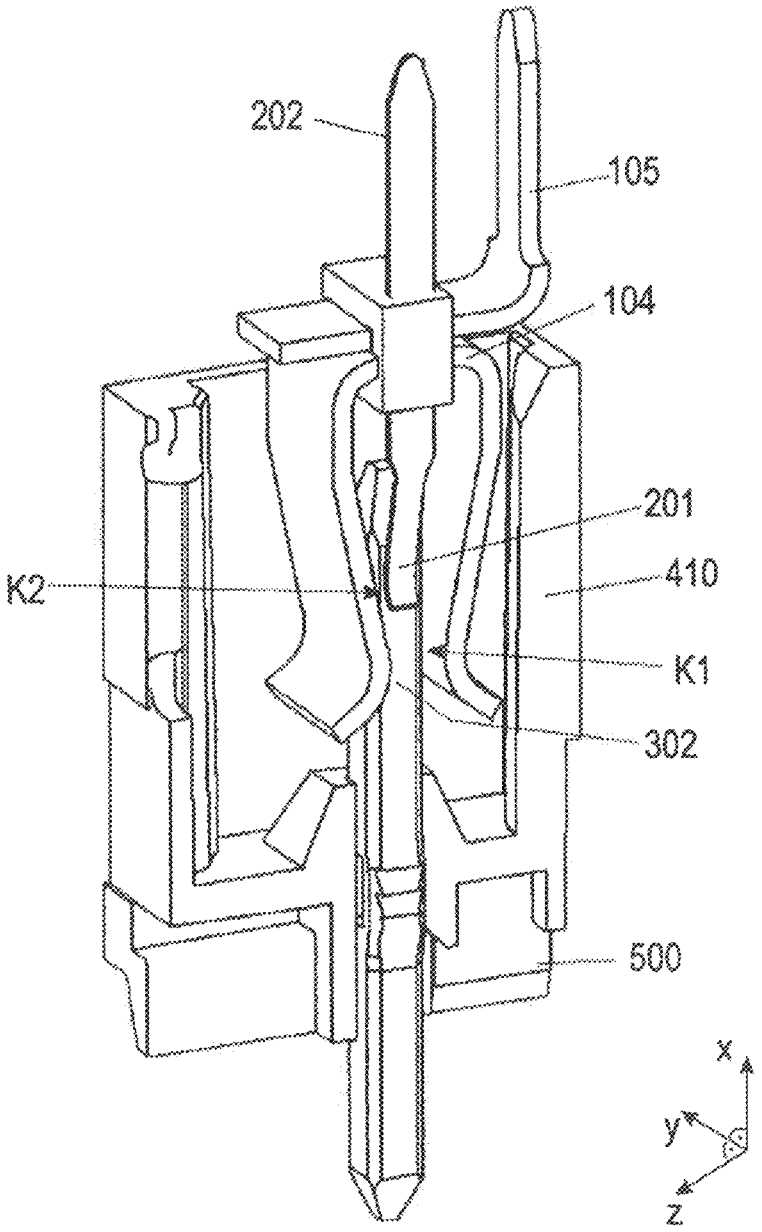
FIG. 1*c* is a perspective view of the plug-in contact of FIG. 1*b* arranged in a housing.
Figure 1D:
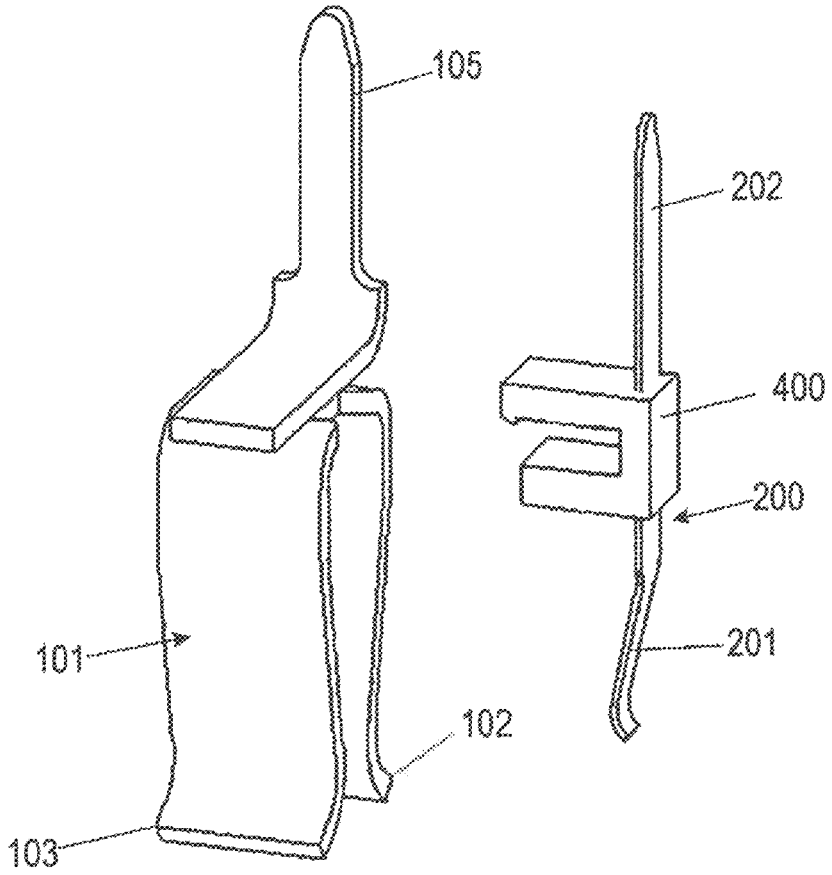
FIG. 1*d* is an exploded perspective view of the socket contact of FIG. 1*a;*

Referring first to FIGS. 1*a*-1*d*, a first embodiment of a plug connection according to the invention includes a plug-in contact 300 and a socket contact 100 which is configured to mate or connect with the plug-in contact in a contact location K1 as shown in FIG. 1*c*. The contacts 300 and 100 are referred to as the main contacts. In a plug connection of this type, one of the main contacts 300 or 100 is associated or connected with an auxiliary contact 200 and forms an assembly and plug unit. This auxiliary contact 200 is preferably a spring contact 201. The spring contact 201 is preferably formed by one or more leaf springs. The auxiliary contact 200 is associated with one of the two main contacts 300 or 100. In the embodiment shown in FIG. 1*a*, the auxiliary contact 200 is associated with but not electrically connected with the contact 100 which is not connected or mated with the contact 300. When the two main contacts mate with or contact each other as shown in FIG. 1*b*, the auxiliary contact contacts the other main contact 100 or 300 with which it is not associated (in this case the other main contact is the contact 300) to form an assembly and plug unit at an auxiliary contact point K2. The auxiliary contact 200 does not contact the main contact 100 or 300 with which it is associated (i.e. the contact 100) in the sense of an assembly and plug unit directly in a conductive manner, but only indirectly via the other main contact.

Figures 5A, 5B, 5C:
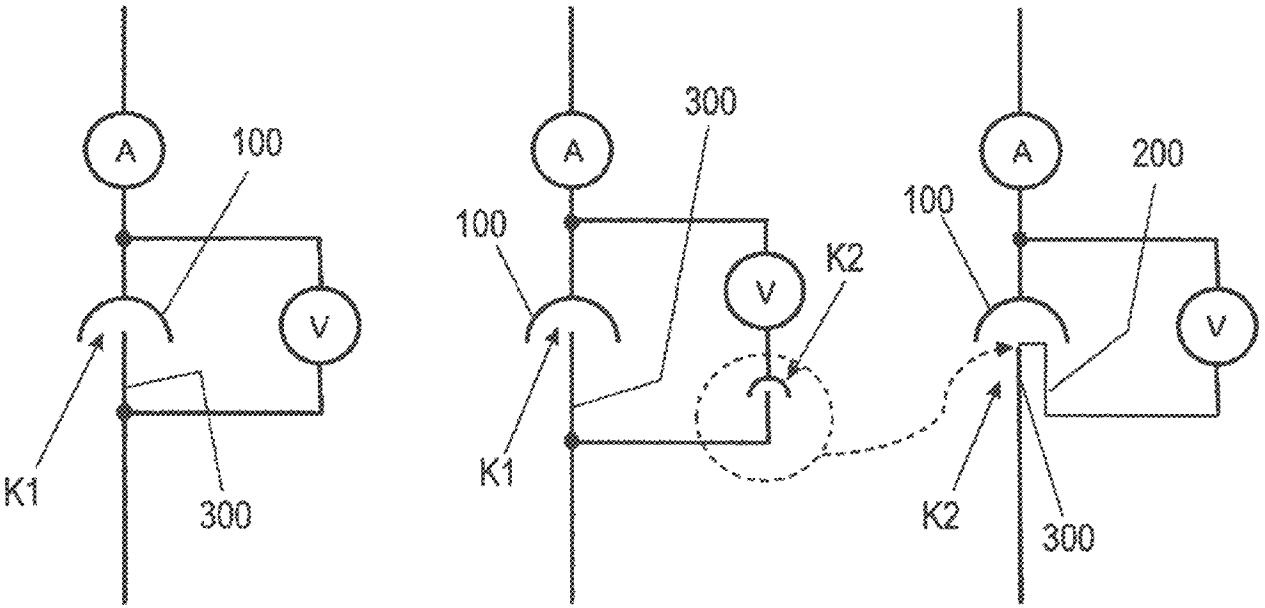
FIGS. 5*a*, 5*b*, and 5*c* show various contact resistance measuring circuits.

FIGS. 5*a*, 5*b* and 5*c* illustrate various methods of contact resistance measurement in the form of schematic sketches. A contact resistance measurement is performed via the main contact point K1 of the plug connection. The goal is to detect the power loss across the contact point K1. This is done by measuring the current that flows through the contact point K1. At the same time, the voltage that drops across the contact point K1 is detected. The product of these two measured values is the power loss of the plug-in contact.

According to FIGS. 5*b* and 5*c*, the current that flows through the contact point K1 is measured on the one hand. The auxiliary contact 200 is connected in parallel to the main contact K1 via a measuring path.

A measurement, particularly a voltage measurement, is performed at the auxiliary contact point K2 in a measuring path which extends or is connected in parallel to the first or main contact point K1 between the two main contacts 100 and 300. A voltage measuring device can be connected on one side to the one main contact—preferably the socket contact 100—with which the auxiliary contact 200 is associated, and the voltage measuring device can be conductively connected on the other side to the auxiliary contact 200 which contacts the other main contact 300, with which it is not associated in the sense of a structural unit.

This measurement depends on the quality of the electrical contact at the main contact point K1 between the plug-in contact 300 and the socket contact 100. According to FIG. 5*c*, the contact point between the auxiliary contact 200 and the socket contact 100 of the plug connection is used as the second contact point K2, which is formed in the direct vicinity of the first contact point, such that the required measurements can be performed with a high degree of precision.

This circuit is preferably used in the plug connections of the embodiments of FIGS. 1 to 4, 6 and 7.

Thus the auxiliary contact 200 contacts the other main contact with which it is not associated in the sense of an assembly and plug unit in a mating fashion of the plug connection at an auxiliary contact point K2 as a section of a circuit for measuring the power loss across the plug connection.

FIG. 1*s* is a perspective view of a socket contact 100 as the first main contact of the plug connection. An auxiliary contact 200 is associated with this socket contact 100 and forms a structural unit and as a unit that can be jointly plugged and handled therewith. The auxiliary contact 200 is designed as a spring contact.

A plug-in contact 300 can be plugged into this socket contact 200 as shown in FIG. 1*b*. This plug-in contact 300 is preferably designed as a pin contact 301. The plug-in contact 300 can be plugged into and unplugged from the socket contact 100 in a direction X. This forms a first contact point K1 between the plug-in contact 300 and the socket contact 100.

The pin contact 301 can be inserted into the socket contact 101 in the plug-in direction X. In FIG. 1*b*, the plug-in contact 300 is formed by a pin contact 301. This pin contact 301 has a tapering contact tip 302. The pin contact 301 further preferably has a square cross section but it can also have a round, rectangular or polygonal cross section. The term "pin contact" as used herein includes flattened contact elements which are also referred to as "contact blades" by those of skill in the contact art.

When the pin contact mates with the socket contact 100 as shown in FIG. 1*c*, the pin contact 301 is resiliently contacted on two opposite sides of the socket contact 100.

The socket contact 100 has a tulip or receptacle contact 101 as shown in FIG. 1*a*. This receptacle contact 101 is preferably designed as a type of leaf spring which is substantially bent into a U shape and has two spring ends formed as opposing leaf spring limbs 102, 103 which are interconnected via a bend region 104. The pin contact 301 is inserted into the receptacle contact 101 and engages or mates with it in the region of a bottleneck 106 between the leaf spring limbs 102, 103 as shown in FIG. 1*b*.

The leaf spring limbs 102, 103 widen at their ends to assist with insertion of the pin contact 301. Further arranged at the receptacle contact 101 is a busbar element or a connecting element 105 which is conductively connected to the receptacle contact 101 and is used for connection with a higher-level assembly (not shown).

The receptacle contact 101 is open in the X direction such that the pin contact 301 can be inserted into it in the plug-in direction X to contact it in the region of the bottleneck 106. The leaf spring limbs 102, 103 extend in the X-Y directions in a Cartesian coordinate system in which the X direction coincides with the plug-in direction.

According to FIGS. 1*a*-1*d*, the auxiliary contact 200 is also designed as a spring contact 201, preferably a leaf spring. The spring contact 201 is arranged in an insulated manner with respect to the main contact with which it is associated. In the embodiment shown in FIGS. 1*a*-1*d*, the associated main contact is the socket contact 100. The leaf spring 201 is preferably aligned at a right angle to the leaf spring limbs 102, 103. A tab terminal follows the spring contact 201 as a terminal end 202, preferably in one piece. The spring contact 201 extends perpendicular to the X-Y direction in a X-Z direction in a Cartesian coordinate system. This means that the auxiliary contact 200 resiliently contacts the plug-in contact 300—particularly the pin contact 301—in a force direction Y perpendicular to the force direction of the spring force of the receptacle contact 101 which acts in the +/−Y direction. This makes it easy to achieve compensation for geometrical tolerances at the auxiliary contact 200 which occur at the actual main plug connection between the pin contact 301 and the receptacle contact 101. It is also possible to associate the auxiliary contact 200 with the plug connection without the spring force adversely affecting the plug-in forces at the plug connection to any significant extent.

According to a preferred embodiment, an insulator 400 made of an insulating material is formed at the main contact which forms a structural connection unit with the auxiliary contact at the socket contact. This insulator 400 can be designed such that it fully or partially encloses the receptacle contact 101 and preferably also a region of the connecting element 105 conductively arranged at the bend region as a partial ring as shown in FIG. 1*b* or a full ring (not shown). The auxiliary contact 200 also passes through the insulator 400 at a distance from the conductive elements, the socket contact 101 and the connecting element 105 of the socket contact 300.

According to another embodiment, the receptacle contact 101, the connecting element 105, and the auxiliary contact 200 can be fully or partially coated with the material such as plastic material of the insulator 400. The insulator 400 and the auxiliary contact 200 may also form a unit which can be clipped onto the associated main contact in order to combine these contacts, particularly the receptacle contacts, in a simple manner with the auxiliary contacts 200 into a structural and jointly pluggable unit. This assembly unit can be insertable into a first outer casing 410. Likewise, the pin contact is pluggable into a second outer casing 500. These outer casings 410, 500 are preferably designed for mating and interlocking if desired.

The auxiliary contact 200 is thus arranged or formed at the socket contact 100 without contacting the conductive elements of this contact. However, it can resiliently contact the pin contact 300 in the mating or connected state due to its configuration as a spring contact.

According to FIGS. 1*a*-1*d*, the pin contact designed as a spring contact 301 contacts the socket contact in the region of one of the sides located below the contact tip 302. Its spring force therefore acts at an angle, particularly perpendicular to the plug-in direction X. The socket contact laterally contacts one of the sides of the pin contact 301 as a leaf spring.

Figure 2A:
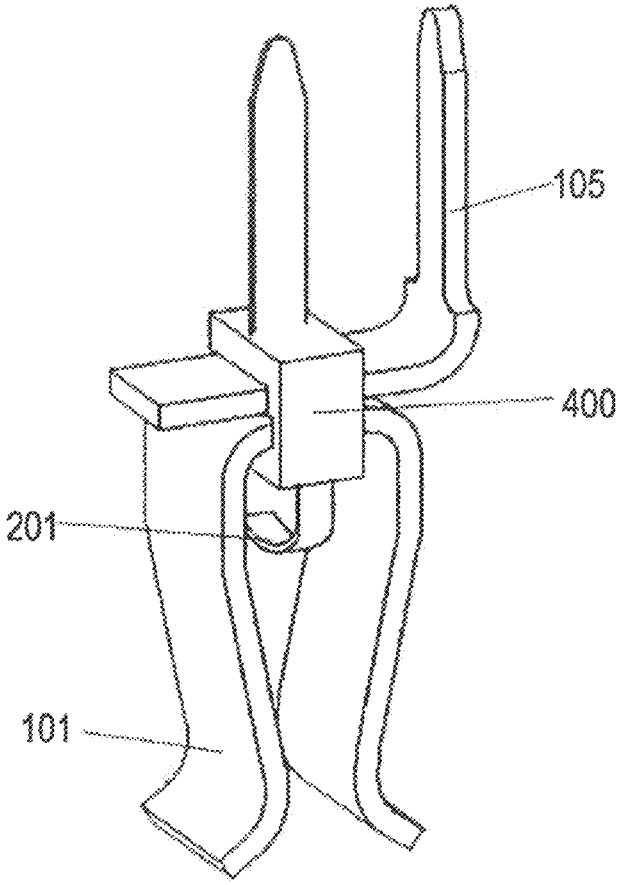
FIG. 2*a* is a perspective view of a socket contact with an auxiliary contact according to a further embodiment.
Figure 2B:
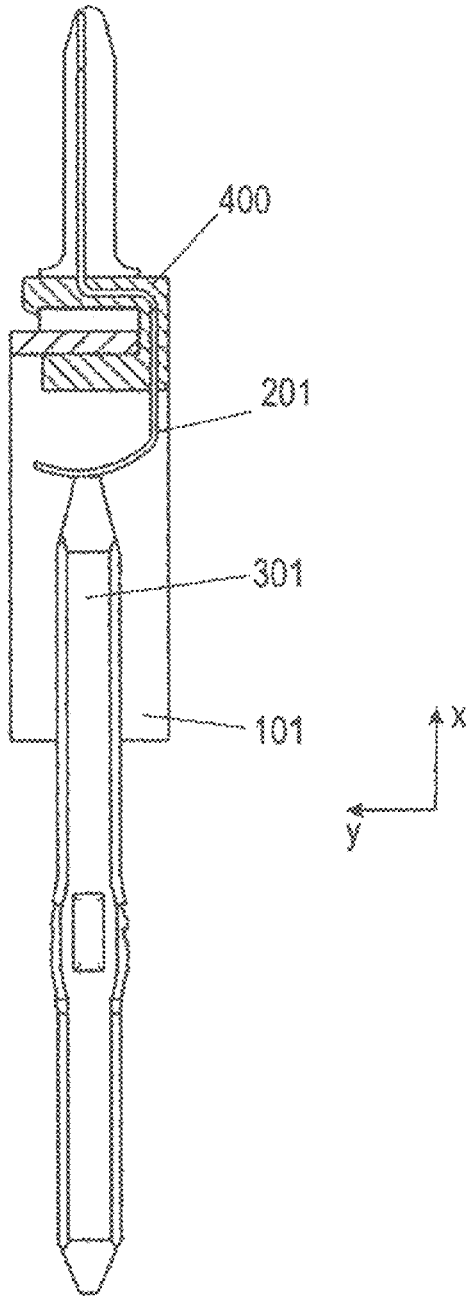
FIG. 2*b* is a partial sectional view of the socket contact of FIG. 2*a* with a pin contact to form a plug-in contact.

Another embodiment of the auxiliary contact is shown in FIGS. 2*a* and 2*b*. The auxiliary contact 200 is also designed as a spring contact 201 and a free end of the leaf spring limb acts against the plug-in direction X and contacts the free end of the plug-in contact, here the pin contact 301, against the plug-in direction X in the mating state shown in FIG. 2*b*. The auxiliary contact 200 is once again secured in an insulator 400, wherein a resilient terminal end 202 projects from the insulator 400 to be able to contact the auxiliary contact 300 and a measuring unit.

Figure 3A:
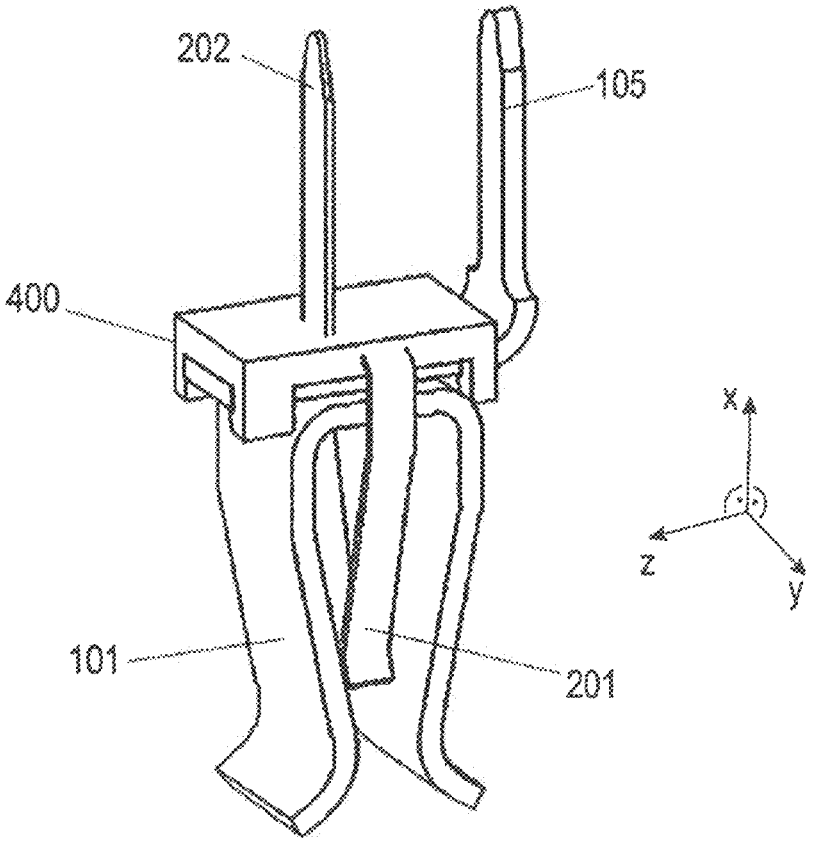
FIG. 3*a* is a perspective view of a socket contact with an auxiliary contact according to another embodiment.
Figure 3B:
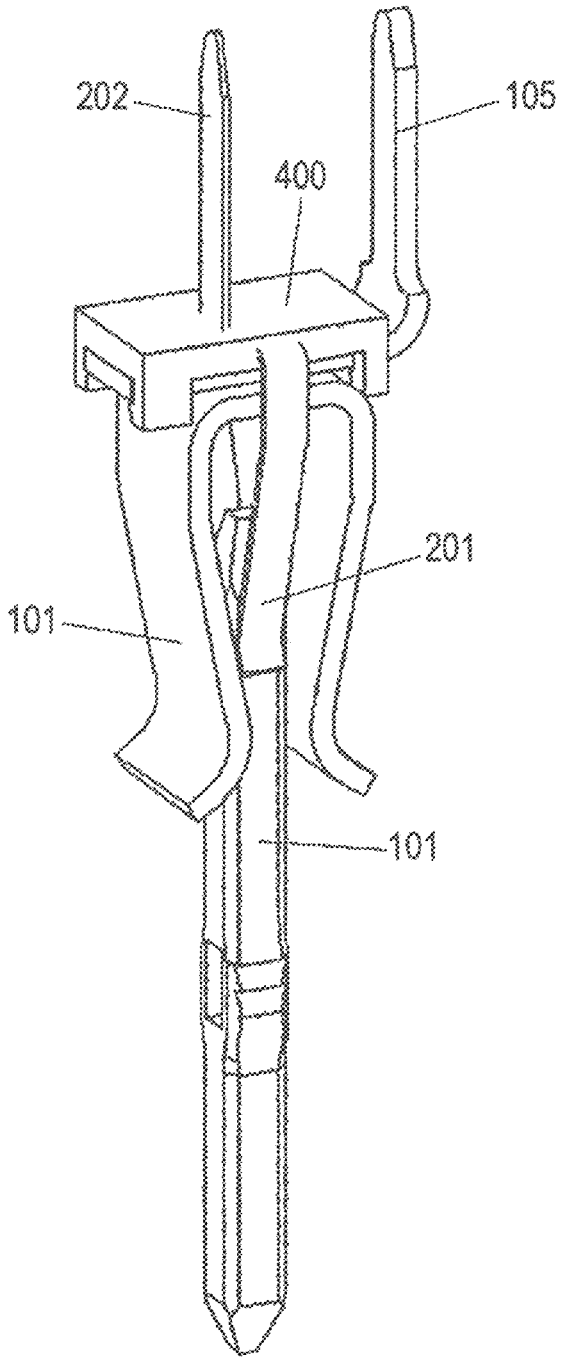
FIG. 3*b* is a perspective view of the socket contact of FIG. 3*a* with a pin contact to form a plug-in contact.
Figure 3C:
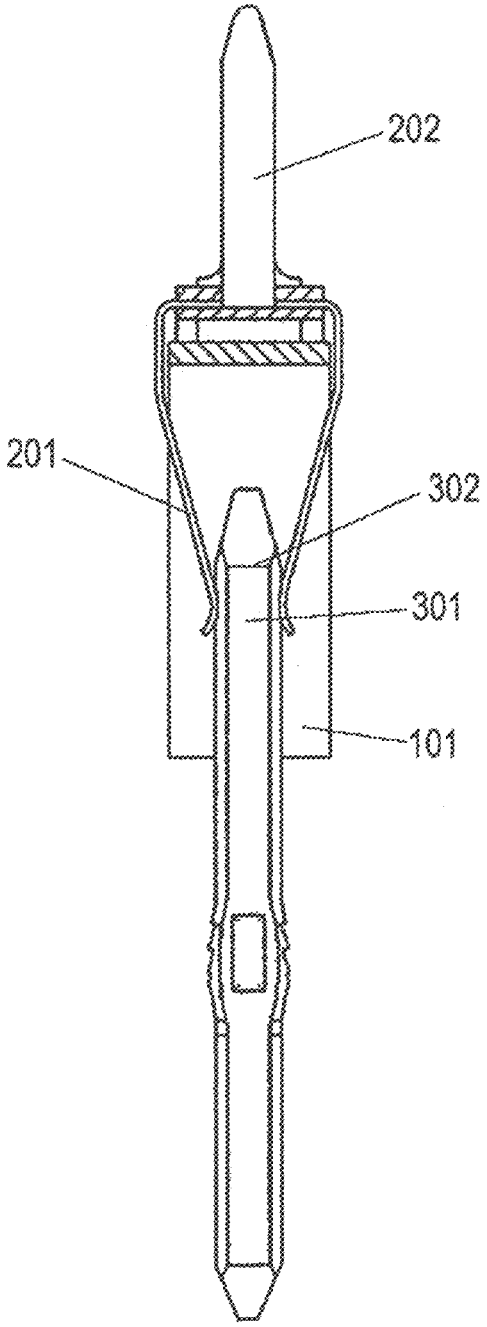
FIG. 3*c* is a partial sectional view of the plug-in contact of FIG. 3*b;*

According to FIGS. 1*a*-1*d*, the auxiliary spring contact 201 contacts the pin contact 301 on one of its sides. It is also conceivable, however, that the auxiliary spring contact resiliently contacts the pin contact 301 on two of its sides. To accomplish this, the auxiliary contact 200 is designed as a receptacle contact and contacts the plug-in contact 300 in such a manner on two sides, particularly on two sides orientated perpendicular to the sides which contacts the actual socket contact 101 of the main contact. Such a configuration is shown in FIGS. 3*a*-3*c*.

The contact between the auxiliary contact 200 and the plug-in contact 300 is further optimized in this manner.

Figure 4A:
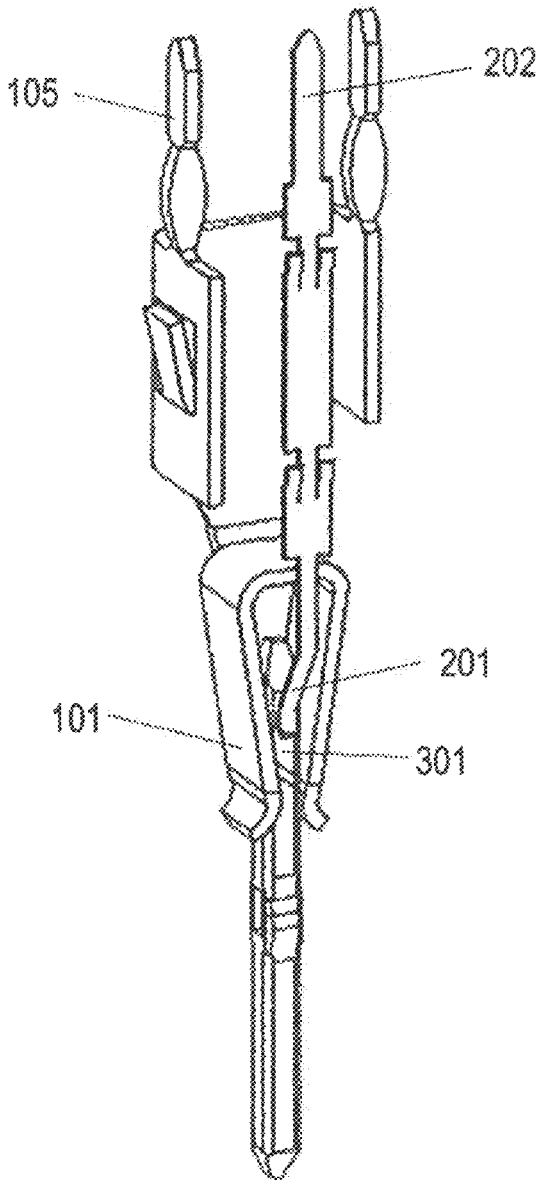
FIG. 4*a* is a perspective view of a further embodiment of a plug connection including a socket contact and a plug-in pin contact.
Figure 4B:
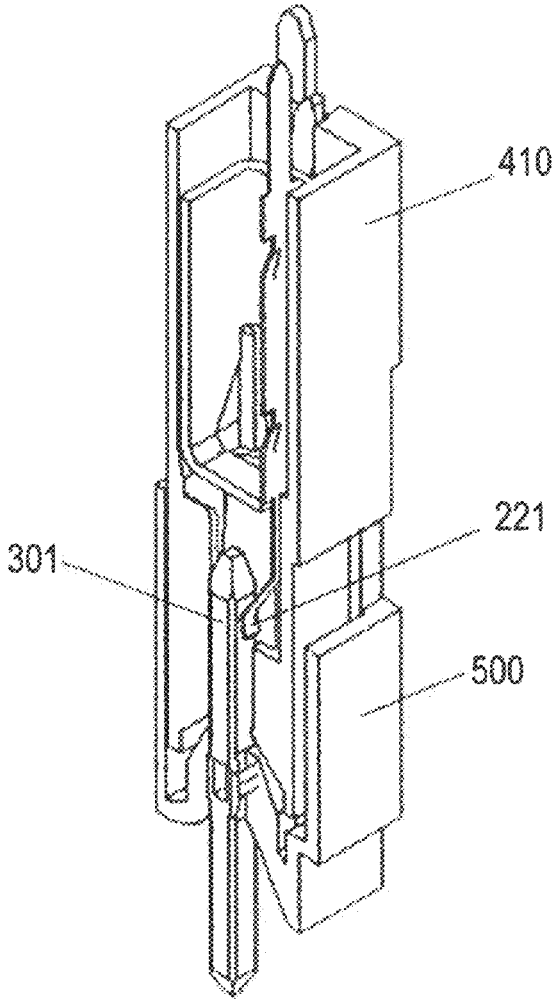
FIG. 4*b* is a cutaway perspective view of the contact of FIG. 4*a* arranged in a housing.
Figure 4C:
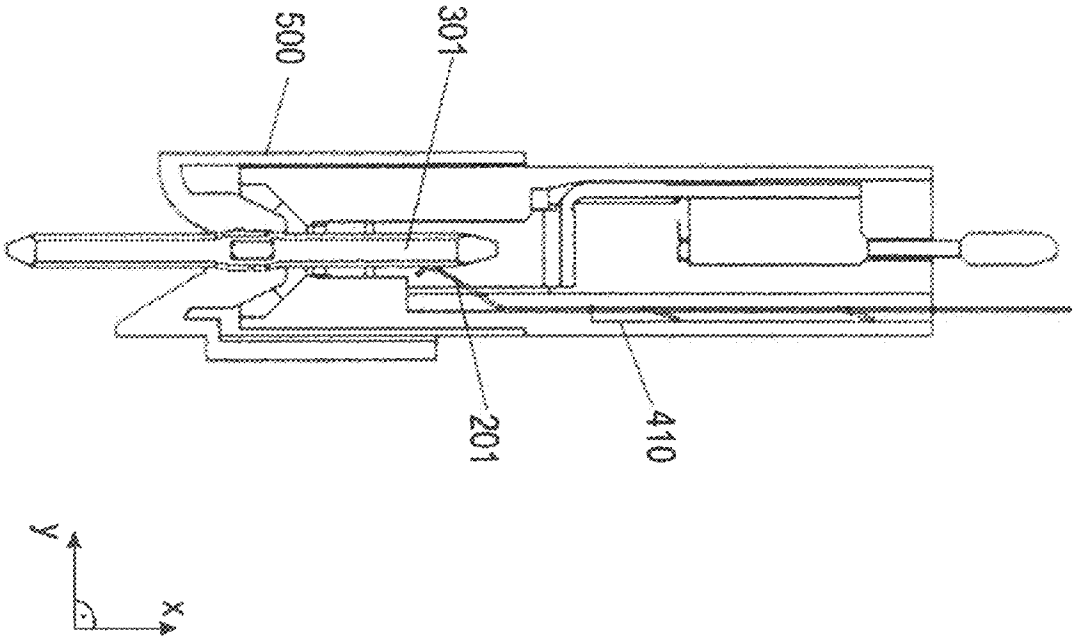
FIG. 4*c* is a front view of the contact and housing of FIG. 4*b;*
Figure 4D:
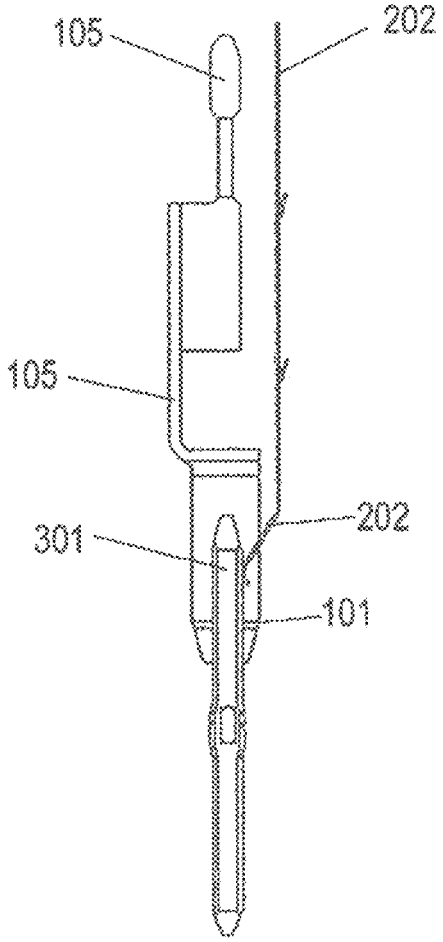
FIG. 4*d* is a side view of the contact of FIG. 4*a;*
Figure 4E:
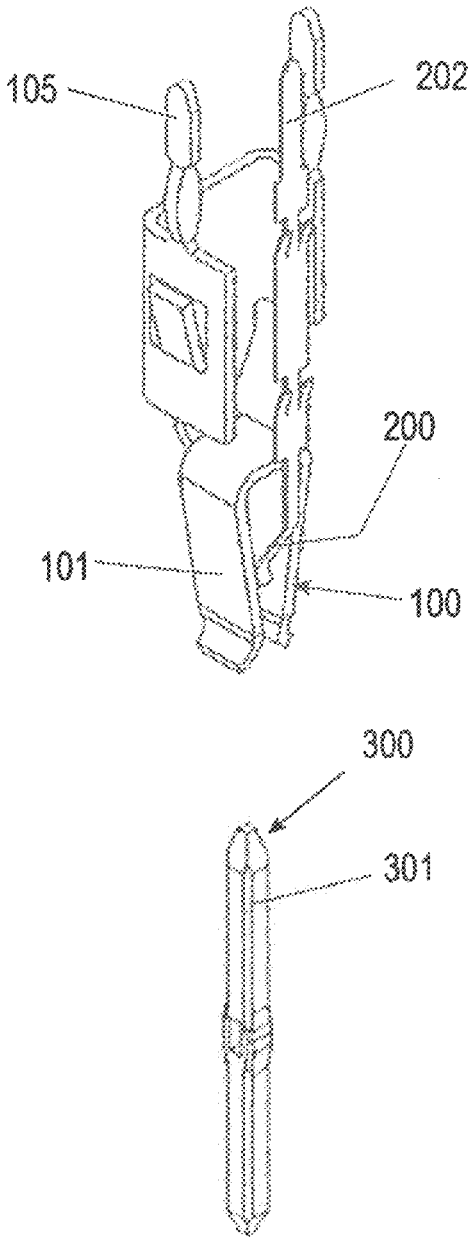
FIG. 4*e* is an exploded perspective view of the contact of FIG. 4*a;*
Figure 4F:
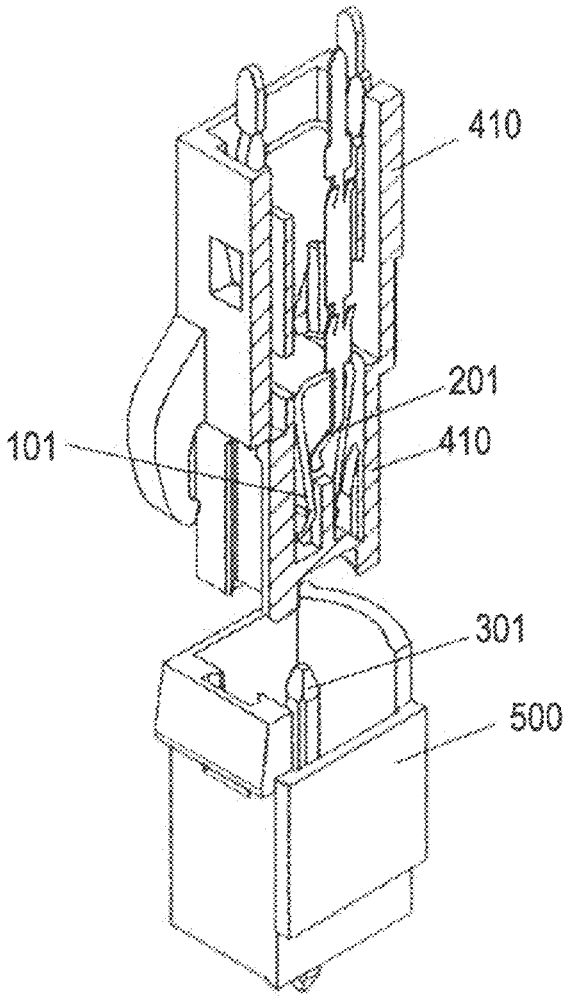
FIG. 4*f* is a partial section exploded view of the contact of FIG. 4*a* arranged in a housing.

According to another embodiment shown in FIGS. 41-4*f*, an outer casing 410 is used as an insulator 400 for the main contact with which the auxiliary contact 200 is associated. Typically, one or more main contacts are inserted into a single or plurality of the outer casings 410. The outer casing 410 for example can be a casing of a connector having one or more of the main contacts. One of the auxiliary contacts 200 is associated with one or with each of the multiple first main contacts. The one or more main contacts, particularly socket contacts 100, and the one or more auxiliary contacts 200 are then inserted into the outer casing 410. According to FIG. 4*b*, one of the socket contacts is inserted into the outer casing 410 which largely encloses its conductive elements except for the terminal points and which holds the socket contact. The auxiliary contact 200 is also inserted into the outer casing 410 and held by it, wherein it is connected in an electrically non-conductive manner to the socket contact 100. The terminal end of the auxiliary contact 200 and the connecting element 105 of the socket contact 100 project from the outer casing 410 at a distance from each other. This can be implemented despite the additional auxiliary contact 200 in dimensions that do not have to be enlarged compared to a configuration without an auxiliary contact 200. The pin contact 101 also has an outer casing 500.

Figure 6A:
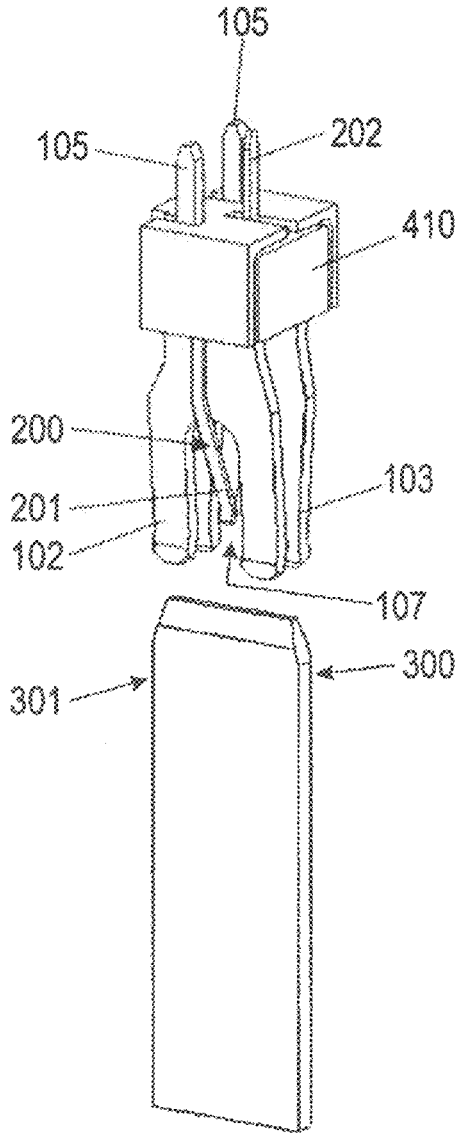
FIGS. 6*a* and 6*b* are perspective views of a plug connection according to another embodiment of the invention with the socket contact and pin contact in disconnected and connected states, respectively.
Figure 6B:
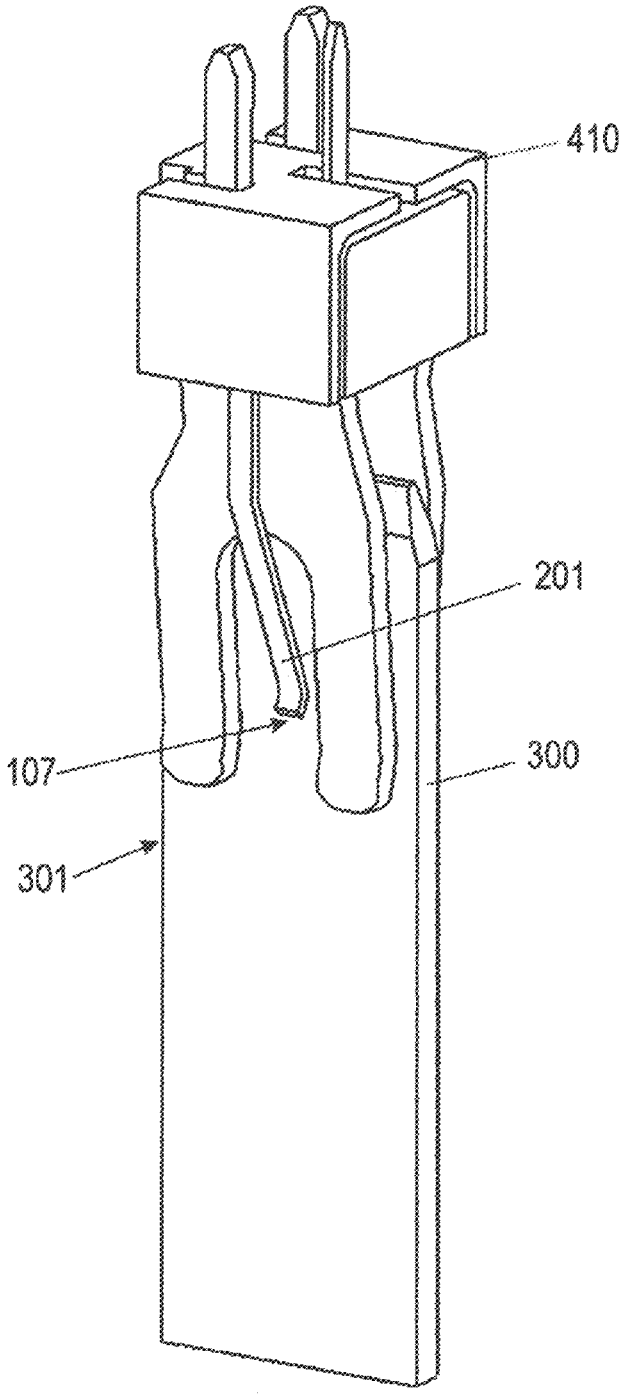
Figure 6C:
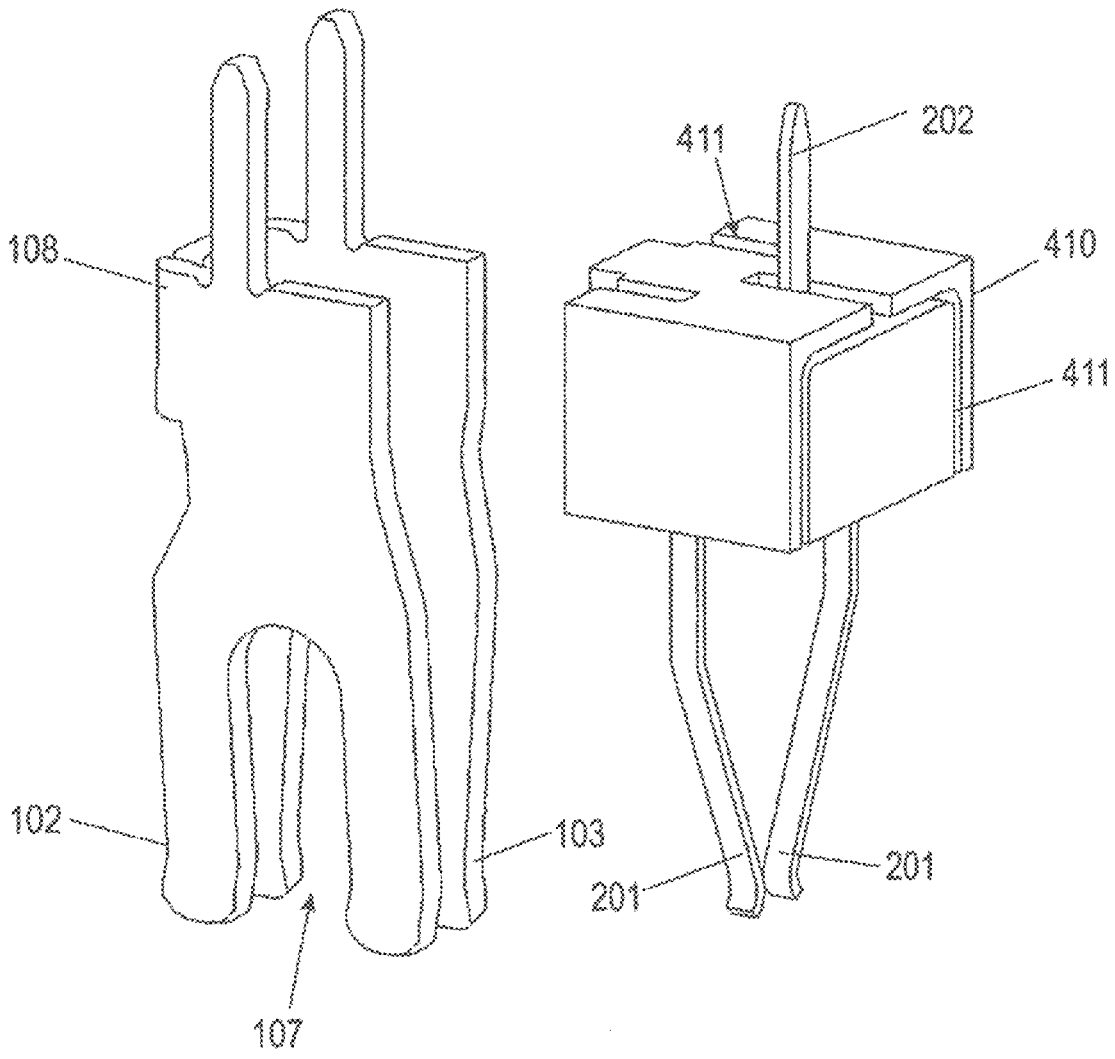
FIG. 6*c* is a partial exploded view of the socket contact of FIG. 6*a;*
Figure 6D:
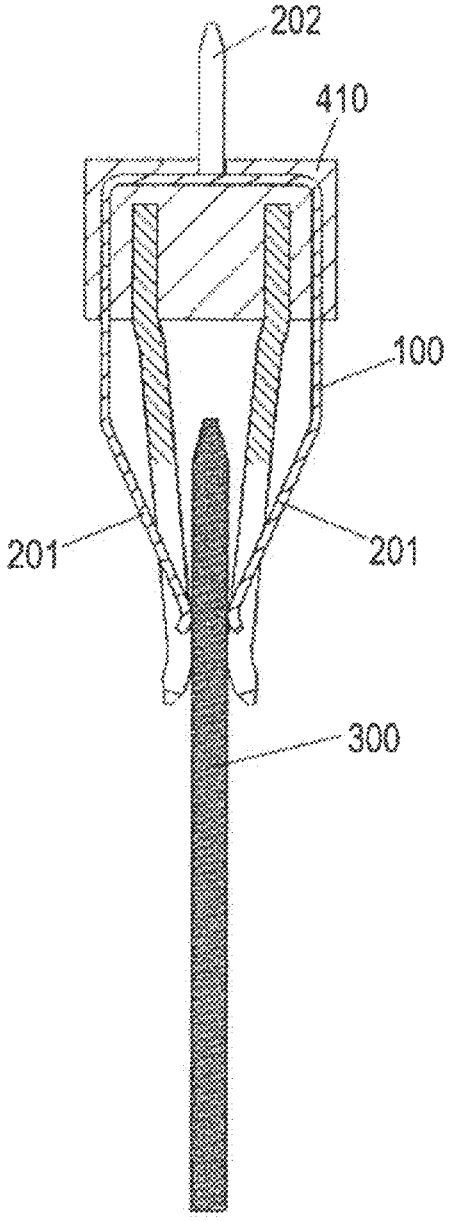
FIG. 6*d* is a partial section view of the plug connection of in the connected state shown in FIG. 6*b;*

FIG. 6*a* is a perspective view of another embodiment of a socket contact 100 as the first main contact of the plug connection. It is a modification of the arrangement from FIGS. 1*a*-1*d* which is further shown in FIGS. 6*b* to 6*d*.

The pin contact 301 is a blade contact. The socket contact is structured like the one in FIG. 1*a*, but slightly wider.

In the embodiment of FIGS. 6*a*-6*d*, an auxiliary contact 200 is once again associated with the socket contact 100 and forms a structural unit and a unit that can be jointly plugged and handled. This auxiliary contact 200 is also once again designed as a spring contact 201. Two or more spring contacts 201 which are conductively interconnected form the auxiliary contact 200. The respective spring contact 201 is resilient parallel to the main contact or the leaf spring limbs 102, 103 of the socket contact 100, respectively. The directions of movement and resilience of the spring contacts 201 and the main contact 100 are thus the same or parallel to each other. This is advantageous for installation under space limitations.

According to FIGS. 6*a*-6*d*, the spring contacts 201 extend outside the leaf spring limbs 102, 103 relative to the contact zone and the free end of the respective spring contact 201 engages laterally in a respective recess 107 in a free end of the respective leaf spring limb or contact 102 or 103.

The two leaf spring contacts 102, 103 are conductively interconnected, preferably formed in one piece and interconnected via a lateral web 108. In addition, they are jointly inserted into a casing 410 which has appropriately designed receiving contours 411 to space the string contacts from each other so that they do not contact each other.

According to FIGS. 6*a*-6*d*, the auxiliary contact 200 contacts the pin contact designed as a spring contact 301 in the region of one of the sides located below the contact tip 302. Its spring force acts at an angle perpendicular to the plug-in direction X and laterally contacts one of the sides of the pin contact 301 as a leaf spring.

Figure 7B:
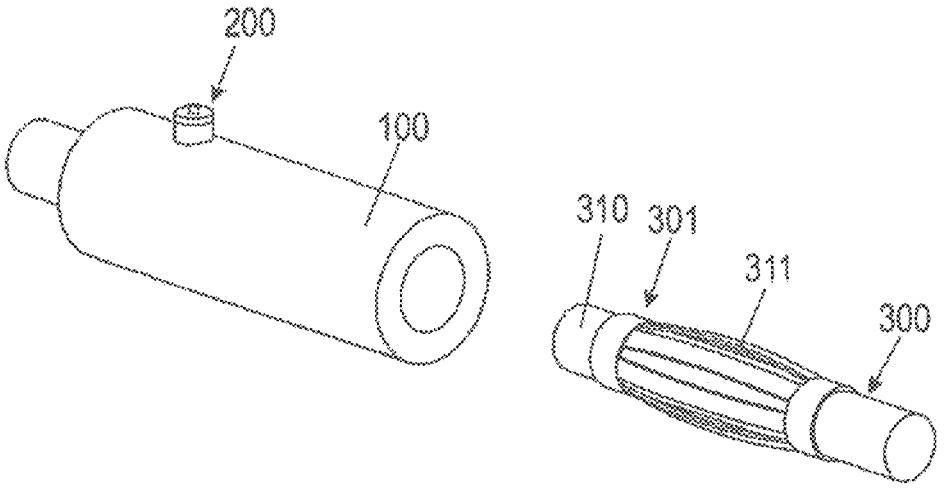
FIGS. 7*a* and 7*b* are perspective views of a plug connection according to a further embodiment of the invention with the socket contact and pin contact in disconnected and connected states, respectively.
Figure 7A:
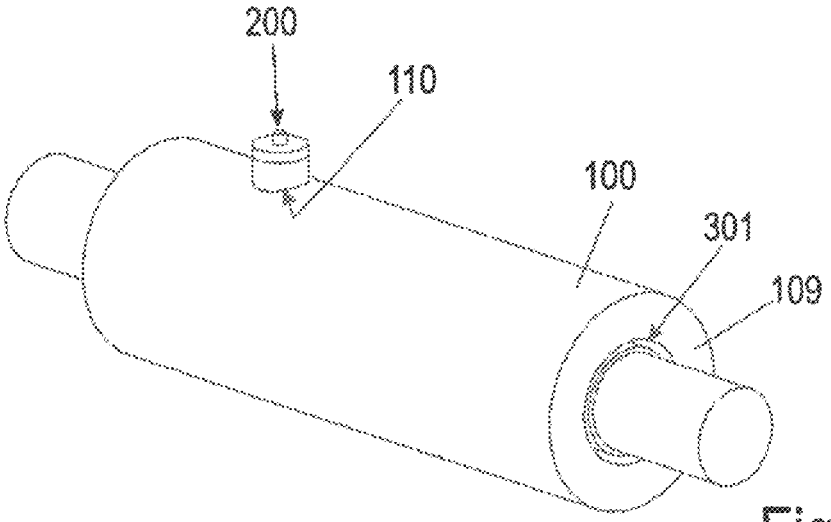
Figure 7C:
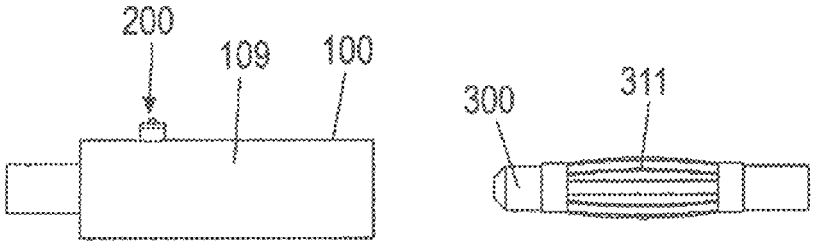
FIG. 7*c* is a side view of the plug connection of FIG. 1*b*.
Figure 7D:
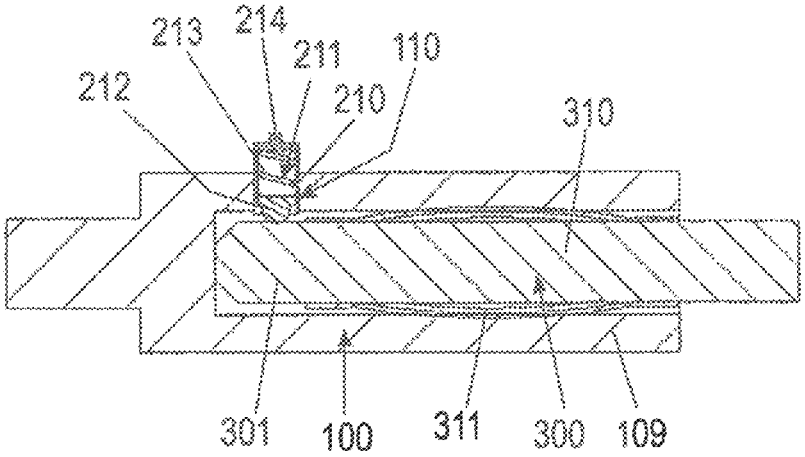
FIG. 7*d* is a sectional view of the plug connection of FIG. 1*a.*

FIG. 7*a* is a perspective view of another socket contact 100 as the first main contact of the plug connection. The socket contact 100 is designed as a cylindrical contact sleeve 109 made of a conductive material. The pin contact 300, on the other hand, is designed as a spring pin contact having contact and spring blades 311 outside on a pin portion 310. A conductive connection between these two elements is established in the plugged-in or mated state by these contact spring blades 311.

As shown in FIGS. 7*a*-7*d*, the auxiliary contact 200 is associated with the socket contact 100. The socket contact 100 includes a lateral cross hole 110 in its cylindrical portion. A cylindrical sleeve 210 is inserted into this cross hole, the sleeve being formed of a non-conductive material. A spring contact 211 is inserted into this sleeve 210. It includes a head 212 and a spring, in this case a coil spring 213, which is supported between the head 212 and an end-side bottom of the sleeve 210. The sleeve 210 includes a connection terminal 214 which is conductively connected to the coil spring 213 and/or the head 212. The head 212 of the spring contact 211 presses at a right angle onto the pin contact 200 in the contacted state. This arrangement can also be integrated in a circuit of the type shown in FIG. 5*c*.

It was explained above with reference to exemplary embodiments that the auxiliary contact designed as a spring contact is associated with the receptacle or socket contact of the plug connection. Alternatively, it is also conceivable to associate the auxiliary contact with the pin contact, if the above embodiments are or can be transferred to respective embodiments not shown here having auxiliary contacts configured as spring contacts, which are associated with the pin contacts, particularly with an insulator. The arrangements shown are preferred, however.

The invention claimed is:

1. An electrical plug connection, comprising (a) a socket contact;

(b) a plug-in contact operable between a connected state wherein said plug-in contact is arranged within and contacts said socket contact in a first contact location and a disconnected state wherein said plug-in contact is removed from said socket contact; and (c) an auxiliary spring contact connected with one of said socket contact and said plug-in contact to form a plug unit assembly, said auxiliary spring contact and another of said plug-in contact and said socket contact defining a second contact location, said auxiliary spring contact being connected in a non-conductive manner with said one contact when said plug-in contact is in a disconnected state and said auxiliary spring contact being connected in a conductive manner with said another contact when said plug-in contact is in a connected state to form the plug unit assembly.

2. The plug connection as defined in claim 1, wherein said plug-in contact comprises a pin contact and said socket contact comprises one of a tulip contact, and a sleeve contact, said pin contact, said socket contact and said auxiliary spring contact forming the plug unit assembly.

3. The plug connection as defined in claim 1, wherein said auxiliary spring contact comprises at least one leaf spring.

4. The plug connection as defined in claim 1, wherein a spring force of said auxiliary spring contact acts on said one contact in a different direction than said another contact.

5. The plug connection as defined in claim 2, wherein said auxiliary spring contact acts on said pin contact perpendicular to the force direction in which said socket contact acts on said pin contact.

6. The plug connection as defined in claim 1, characterized in that the spring force of the auxiliary spring contact designed as a spring contact acts on said another contact in the same direction as said one contact.

7. The plug connection as defined in claim 2, wherein said auxiliary spring contact acts laterally on said pin contact.

8. The plug connection as defined in claim 2, wherein said spring contact acts on a tip of said pin contact against a plug-in direction in which said pin contact is inserted into said socket contact.

9. The plug connection as defined in claim 2, wherein in said auxiliary spring contact is aligned perpendicular to said socket contact.

10. The plug connection as defined in claim 2, wherein said auxiliary spring contact and said socket contact are spaced from each other in an insulator.

11. The plug connection as defined in claim 10, wherein said insulator and said auxiliary spring contact are formed as a unit which is clipped onto said one contact.

12. The plug connection as defined in claim 10, wherein said insulator comprises an outer housing.

13. The plug connection as defined in claim 1, wherein said socket contact comprises a cylindrical sleeve containing an opening, said auxiliary spring contact passing through said opening and resiliently contacting said plug-in contact.

14. The plug connection as defined in claim 1, and further comprising two connectors, one of which includes a plurality of said one contacts and auxiliary spring contacts associated therewith, respectively, the other of which includes a plurality of said another contacts, each connector being arranged in an outer housing which can be plugged together.

15. The plug connection as defined in claim 1, wherein said plug-in contact forms an assembly and plug unit with said auxiliary spring contact.

16. The plug connection as defined in claim 1, wherein said auxiliary spring contact contacts said another contact at said second contact location to form an assembly and plug unit as a section of a circuit for measuring a power loss across the plug connection.

* * * * *